United States Patent [19]

Marshall

[11] 4,070,235

[45] Jan. 24, 1978

[54] METHOD OF MAKING BIAXIALLY ORIENTED NONWOVEN FABRICS

[76] Inventor: Preston F. Marshall, 191 Gould St., Walpole, Mass. 02081

[21] Appl. No.: 642,667

[22] Filed: Dec. 19, 1975

Related U.S. Application Data

[63] Continuation-in-part of Ser. No. 506,843, Sept. 17, 1974, Pat. No. 3,969,561.

[51] Int. Cl.[2] ..... D21H 5/02

[52] U.S. Cl. ..... 162/116; 162/149; 162/211; 162/348

[58] Field of Search ..... 162/116, 146, 149, 208, 162/211, 212, 216, 217, 348, DIG. 1

[56] References Cited

U.S. PATENT DOCUMENTS

| | | | |
|---|---|---|---|
| 3,350,260 | 10/1967 | Johnson | 162/116 |
| 3,775,244 | 11/1973 | Hubschmann | 162/116 X |
| 3,822,183 | 7/1974 | McKnight | 162/216 X |

*Primary Examiner*—Richard V. Fisher

[57] ABSTRACT

A nonwoven fabric having alternating stripes of high fiber density and low fiber density has fibers of at least ½ inch in length and fibers of less than ½ inch in length, preferably under ¼ inch in length. The fabric is made in such a manner as to produce parallel twistless ribbon strands in the high fiber density areas containing both short and long fibers. The twistless ribbon strands are bridged together by the long fibers so as to form the nonwoven fabric. A majority of the bridging long fibers have at least a portion of their length included in adjacent twistless ribbon strands; said ribbon strands having at least one strand width space between said ribbon strands. A majority of said short fibers are disposed in said high fiber density areas together with a majority of said long fibers, both being oriented in substantially one direction, for example, the machine direction, while substantially all of the long fibers in the adjacent and bridging low fiber density areas are oriented in a direction substantially normal to that direction.

6 Claims, 3 Drawing Figures

FIG. 3
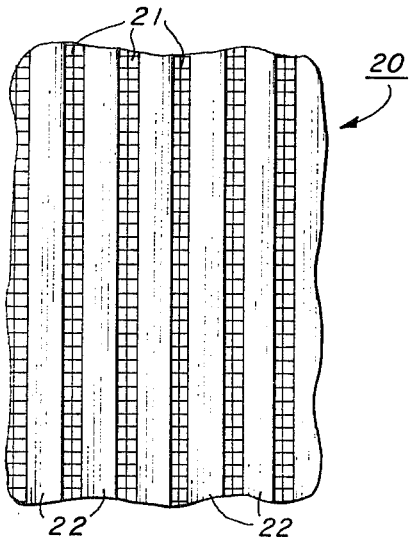
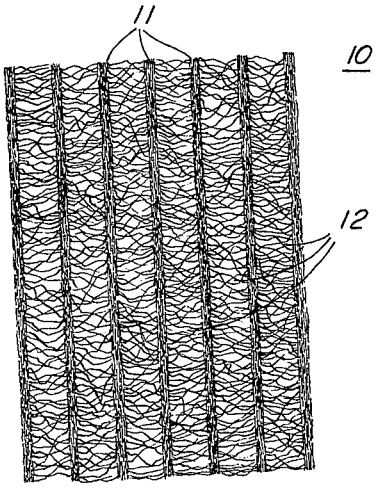
FIG. 1
FIG. 2
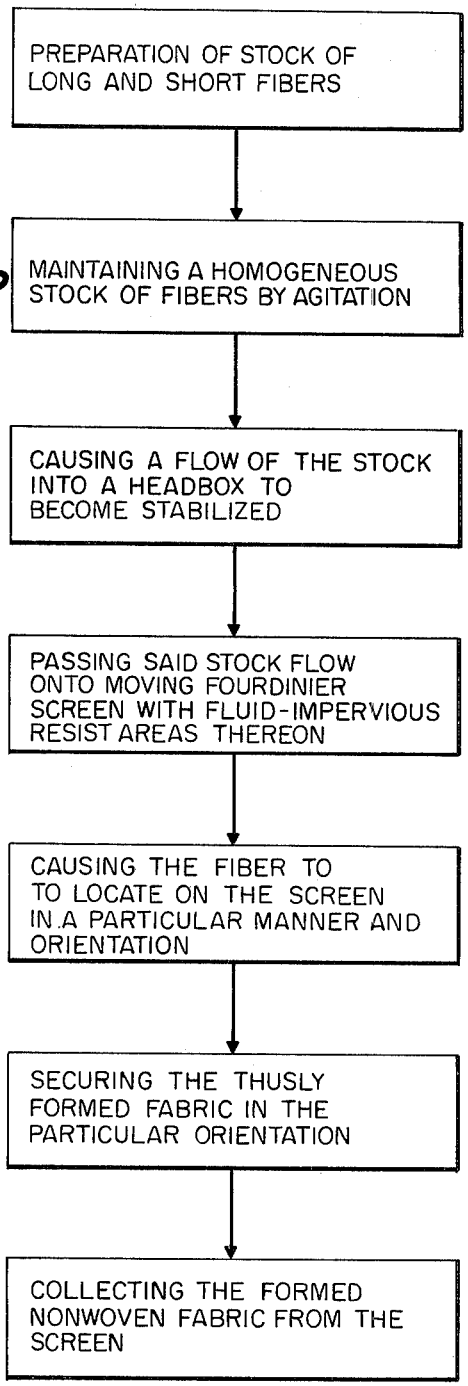

METHOD OF MAKING BIAXIALLY ORIENTED NONWOVEN FABRICS

CROSS-REFERENCE TO OTHER APPLICATIONS

This application is a continuation-in-part of U.S. Ser. No. 506,843, filed Sept. 17, 1974, now U.S. Pat. No. 3,969,561, issued on July 13, 1976.

BACKGROUND OF THE INVENTION

This invention relates to biaxially oriented striped nonwoven fabrics and a method for making same, and more particularly, to a method of making a nonwoven fabric having alternating high fiber density and low fiber density striped portions, and fiber mixtures of both long and short fiber lengths, said fabric having substantially biaxial orientation of fibers throughout the fabric.

Nonwoven fabrics are now used for a variety of purposes in a number of industries. These fabrics have been made traditionally by methods such as carding, garnetting, air-laying and the like. Nonwoven webs have been made to have most of the fibers therein oriented in the machine direction; other nonwoven webs have been made to have some cross orientation; and still other webs have been produced having a randomized fiber distribution. However, substantially all of these webs are lacking in any surface character or natural decorative effect. Nowhere in the art, heretofore, has a nonwoven fabric been made in an unlayered structure having a striped construction wherein half of the stripes have a high fiber density and the other half of the stripes are of low fiber density; furthermore, no fabrics have yet been made in such a striped manner, for example, wherein a majority of the fibers in the high fiber density stripes are oriented in a direction parallel to stripes (machine direction), while a majority of the fibers in the low fiber density stripes are oriented in a direction substantially perpendicular to the stripes (cross direction). No method has yet been devised for manufacturing such a fabric with at least two types of orientation disposed thereon simultaneously.

Furthermore, it has been discovered that while the biaxially oriented nonwoven fabric described above has been very satisfactory in many respects, efforts have been undertaken to attempt to reduce the cost of raw materials therein, while increasing the bulk, softness, feel and look of the resulting nonwoven fabric. Thus, a papermaker's method for making this nonwoven, using short paper fibers, will reduce costs dramatically.

Accordingly, it is an object of the present invention to produce a method of making a nonwoven fabric with long and short fibers therein that has a striped patterned construction manufactured into it, which would be able to be produced with relatively inexpensive short fibered materials.

It is another object of this invention to produce a striped nonwoven fabric having alternating stripes of high fiber density and low fiber density.

It is a further object of the present invention to produce a striped nonwoven fabric having alternating high fiber density stripes and low fiber density stripes wherein a majority of the fibers in the high fiber density stripes are oriented in the machine direction while a majority of the fibers in the low fiber density stripes are oriented in the cross direction.

It is still a further object to produce a striped nonwoven fabric wherein the direction of the stripes are running across the fabric or at some other angle that is bias to the angle of the direction of travel of the fabric.

SUMMARY OF THE INVENTION

By placing lines of fluid-impervious materials on or over a moving fourdrinier screen, an unlayered nonwoven fabric having, for example, alternating stripes of high fiber density areas can be produced by papermaking techniques wherein substantially all of the fibers in the high fiber density stripes are oriented in the direction of the fluid-impervious lines, and substantially all of the fibers in the low fiber density stripes are oriented in a direction substantially normal to that direction. The fibers used in making this nonwoven fabric comprise long fibers of at least ½ inch in length and short fibers of less than ½ inch in length, preferably ¼ inch in length. Since the short fibers are of insufficient length of bridge the fluid-impervious lines or areas, most of them will be deposited with substantially their full length within impervious areas on the collection screen so as to form "twistless ribbon strands." These areas also contain a majority of the long fibers from a stock flow being fed thereto, while a lesser number of the long fibers bridge across the resist lines or areas and remain in a generally cross direction to those resist areas or lines. A majority of the bridging long fibers have at least a portion of their length included in adjacent high fiber density areas. The nonwoven fabric can be bound together in a number of ways, including the use of thermoplastic fibers as some of the short fibers therein, so that upon heating said thermoplastic fibers, they will bond the long bridging fibers at their ends where they are incorporated into the stripes but leave the bridging fiber itself substantially free of binder between the stripes, thus enhancing the drape and softness in these areas, while increasing the bulk of the high fiber density areas.

BRIEF DESCRIPTION OF THE DRAWINGS

FIG. 1 shows a plan view of a nonwoven fabric made with the process of this invention.

FIG. 2 is a flow chart outlining the steps of the process of this invention.

FIG. 3 is a partial plane view of a screen having finger-like striping bars disposed on and thereover.

DESCRIPTION OF THE PREFERRED EMBODIMENTS

Referring to FIG. 1 of the drawings, there is shown an unlayered nonwoven fabric 10 having alternating high fiber density stripes 11 and low fiber density stripes 12. As can be seen in the drawing, the majority of the fibers in the high fiber density stripes 11 are oriented in a direction that substantially follows the direction of a moving fourdrinier screen upon which such a fabric is made (machine direction), that is to say, that those fibers are aligned substantially parallel to the length of the fabric. However, the majority of the fibers in the low fiber density stripes 12 are oriented in a direction that is substantially across the width of the fabric 10 (cross direction orientation), that is to say, these fibers are aligned substantially normal to the fibers in the high fiber density stripes 11 and in bridging relationship with those stripes. These alternating striped portions of varying orientation are formed simultaneously as described below.

A nonwoven fabric such as shown in FIG. 1 can be made by papermaking techniques wherein a stock of blended fibers comprising long fibers and short fibers are prepared and held in a chest at a particular consistency, while being agitated to prevent settling and separation of the solids. The stock can then flow to an inlet distribution system where the flow spreads to the full machine width, discharging the stock into the headbox, where the flow becomes stabilized. At this point, the stabilized stock flow can then pass onto a moving fourdrinier wire screen.

The fourdrinier screen 20, as shown in FIG. 3, has fluid-impervious resist areas placed thereon in various configurations, for example, continuous and parallel stripes 22. Thus, as the stock flow passes onto the fourdrinier screen 20, a majority of both the long and short fibers are drawn to the areas thereon outside the fluid-impervious resist areas, or in the case of the example, in between the fluid-impervious stripes such as at 21. This, of course, would be especially true of the short fibers since they would not be subject to forces of more than one of the areas outside of the fluid-impervious areas and would not attempt to bridge a fluid-impervious area. Rather, because of the movement of the fourdrinier screen, they will be increasingly drawn to the pervious portion of the screen and will be oriented in the direction of the fluid-impervious stripes, or parallel to the machine direction of the formed web.

Simultaneously, a minority of the fibers, especially the long fibers, will be subject to the forces of at least two fluid-pervious areas, thereby causing some of the long fibers to bridge across a fluid-impervious area. Thus, such fibers will be oriented in a direction substantially normal to the axis of the fluid-impervious resist areas.

If the striping bars or fluid-impervious resist areas are disposed fairly close together so that the distance between the bars is less than a fiber length, and preferably less than one-half the length of a long fiber, the fibers that do not bridge the striping bars will be carried into a high fiber density stripe or the pervious area that lies between the striping bars. As described earlier herein, a high fiber density stripe formed by a majority of the fibers is therfore induced to have a primary orientation along the axis of the striping bar.

The long fibers are, for the purposes of this invention, at least one-half inch in length or more. The short fibers used herein may be paper fibers, cotton linters, short thermoplastic fibers, or the like, or combinations thereof, so long as the fibers are less than one-half inch in length. If short thermoplastic binder fibers are used, either alone or with other short fibers, then they too will be drawn into the high fiber density stripes and, when activated, will bond the long bridging fibers at their ends where they are incorporated into the stripes, but will leave the bridging fiber itself substantially free of binder between the high fiber density stripes, thus enhancing drape and softness in those areas, and in the total fabric.

For the purposes of this invention, these high fiber density areas comprising long and short fibers are referred to as twistless ribbon strands herein, and should have at least one strand width in spacing between the strands, but not so much space that the long fibers are not able to bridge thereacross. While it is true that some short fibers will be found in the low fiber density areas mixed in with the long bridging fibers, a majority of the short fibers will be disposed within the twistless ribbon strands. Therefore, the low fiber density stripes will have a lower total fiber length per unit of area of short fibers therein than the twistless ribbon strands. Furthermore, most of the long bridging fibers will have at least a portion of their length in adjacent strands, connecting the twistless strands, thereby forming the nonwoven fabric.

In all but the lightest weight fabrics, the top of the fabric, that is the portion of the fabric furthest removed from the fourdrinier screen, appears to be covered by a minor portion of long and short fibers positioned generally across the entire width of the webs. As the fibers in the stock flow position themselves on the fourdrinier screen and fluid-impervious resist areas, and become increasingly thick and pass off the striping bars, the fluid-borne fibers become less generally controlled by the water's diverging action between fluid pervious and impervious areas, and then fall on the uppermost portions of the thusly formed fabric in a somewhat randomized fashion. The web at this point can best be described as having high and low fiber density stripes having a somewhat randomized covering portion of long and short fibers integrated therewith. However, a majority of the fibers are still positioned in a striped fashion and in an orientation parallel to the length of the web.

If the striping bars are moved closer together and arranged so that they are spaced on, for example ¾ inch centers, it becomes apparent that a much more pronounced ribbed structure is formed. By "ribbed structure," it is meant that the high fiber density stripes have so many fibers therein that this portion of the web structure becomes almost semi-circular in its construction, while the low fiber density areas remain rather flat. This arrangement could well be described as being a washboard configuration. The fabrics produced by this invention have a variety of uses and could be used as disposable curtains or drapes; decorative narrow ribbons and for florist ribbons; sweatbands; cling type bandages; disposable tablecloths and the like.

Of course, other designs of striping bars can be used in different arrangements to produce similarly biaxially oriented nonwoven fabrics. For example, impervious resist areas can be designed into the fourdrinier screen as a substitute for the striping bars. Resist areas can also be formed in the shape of a star, or the like, directly on the screen, so that as the portion of the screen carrying the fluid-impervious resist areas passes through the apparatus, and the fibers have been deposited thereon and run over the suction roll, the biaxial orientation of fibers will occur on and around the resist areas on the screen producing a rather unique fabric. The resist areas will be covered by fibers in a manner as to produce low fiber density areas wherein the fibers are oriented in a direction substantially across each of the finger-like extensions on the star, or normal to the particular configuration, for example, while the area of the fabric web directly adjacent the resist area will have fibers oriented in a direction substantially parallel with the contours of the configuration of the resist area, and the fibers on the rest of the web not affected by resist areas will have a random, cross or machine orientation as desired. Other configurations could also be made on the screen to produce other similar biaxially oriented patterns thereof.

If the length of the striping bars blocking the screen is reduced so that they do not extend so far as to cover the entire screen collecting surface, then a substantially random web will be formed on the unblocked screen surface causing a random web to become superimposed over and integrally connected with the striped web. The proportion of web weight that is striped and has been biaxially oriented, to the proportion of superimposed web that is random can, of course, be varied by adjusting the proportion of the screen that is blocked by the striping bars.

Of course, as stated and described herein earlier, resist areas may also be placed at any other angles, other than parallel or normal to the direction of travel of the screen to produce fabrics with stripes at a bias to the direction of travel of the fabrics.

Since it is obvious that many modifications and embodiments can be made in the above-described invention without changing the spirit and scope of the invention, it is intended that this invention not be limited by anything other than the appended claims.

What is claimed is:

1. A method of making biaxially oriented nonwoven fabrics having areas of low fiber density and high fiber density wherein a majority of the fibers in said low fiber density areas are oriented in a direction substantially normal to the fibers in the directly adjacent high fiber density areas and a majority of the fibers in said high fiber density areas that lie directly adjacent said low fiber density areas are oriented in a direction substantially parallel with the contours of the configuration of the adjacent low fiber density areas, comprising:

preparing an aqueous slurry of a stock of blended long and short fibers, said long fibers being at least one-half inch in length or more and said short fibers being less than one-half inch in length;

maintaining said stock of fibers in an agitated state;

causing a flow of said stock to pass into a headbox, and stabilizing same therein;

passing said stabilized stock flow onto a moving fourdrinier screen having liquid-impervious resist areas thereon of a particular contour;

causing a majority of said long and short fibers in said stock flow to locate outside said liquid-impervious resist areas said majority of fibers that lie directly adjacent said liquid-impervious resist areas orienting themselves in a direction substantially parallel with the contours of said resist areas;

simultaneously causing, by the water's diverging action between liquid pervious and impervious areas, a minority of said long and short fibers in said stock flow to locate across said liquid impervious resist areas, said minority of said long and short fibers orienting themselves in a substantially cross direction normal to the axis of said liquid impervious resist areas;

securing said biaxially oriented nonwoven fabric in said orientation as described herein;

carrying said biaxially oriented nonwoven fabric on said moving fourdrinier screen toward a pick-up means for collecting the thusly formed fabric; and, collecting said fabric on said pick-up means.

2. The method of claim 1 wherein said liquid-impervious resist areas are approximately equidistantly spaced-apart finger-like striping bars disposed on and over said screen, and includes causing said stock flow to form a nonwoven biaxially oriented fabric comprising alternating stripes of high fiber density and low fiber density, a majority of said long and short fibers in said stock flow locating between said finger-like striping bars, said majority of fibers orienting themselves in a substantially lengthwise direction parallel to the axis of said striping bars, and a minority of said fibers in said stock flow locating across said finger-like striping bars, said minority of fibers orienting themselves in a substantially cross direction normal to the axis of said striping bars.

3. The method of claim 2 wherein the distance between said striping bars is less than an average long fiber length.

4. The method of claim 2 wherein the distance between said striping bars is less than one-half of an average long fiber length.

5. The method of claim 2 including causing a portion of said fabric to have generally cross-oriented fibers disposed across, and integrally with, the top of said striped fabric by less generally controlling the fibers in the stock flow with the water's diverging action.

6. The method of claim 2 including causing a portion of said fabric to have generally randomized fibers disposed on, and integrally with, the top of said striped fabric by less generally controlling the fibers in the stock flow with the water's diverging action.

* * * * *